United States Patent [19]

Holland et al.

[11] 3,946,470

[45] Mar. 30, 1976

[54] DOUBLE FLUSH RIVETING MACHINE

[75] Inventors: Charles L. Holland, Escondido; Clarence P. Rolla, San Diego, both of Calif.

[73] Assignee: General Dynamics Corporation, San Diego, Calif.

[22] Filed: Apr. 7, 1975

[21] Appl. No.: 566,020

[52] U.S. Cl. ..... 29/34 B; 29/26 R

[51] Int. Cl.[2] ..... B23B 11/00

[58] Field of Search ..... 29/34 B, 26 R, 26 A

[56] References Cited

UNITED STATES PATENTS 2,216,403 10/1940 Oeckl et al. ..... 29/26

2,598,106 5/1952 Boyle ..... 29/26

*Primary Examiner*—Gil Weidenfeld

*Attorney, Agent, or Firm*—John R. Duncan

[57] ABSTRACT

An accessory for riveting machines, replacing the conventional lower anvil, which permits both the top and bottom exposed surfaces of a laminated assembly to be countersunk and flush riveted. It includes a selectively and sequentially engageable sheet clamping means, countersinking means, rivet anvil, and rivet squeezing means.

14 Claims, 11 Drawing Figures

DOUBLE FLUSH RIVETING MACHINE

BACKGROUND OF THE INVENTION

The invention relates generally to automatic riveting machines, and more specifically to an accessory for such machines which permits double flush riveting.

Conventional automatic riveting machines, such as those disclosed by F. A. Boyle in U.S. Pat. No. 2,598,106, and by J. J. White, et al in U.S. Pat. No. 3,030,695, are capable of rapidly installing and squeezing a variety of rivet shapes and types. However, they are generally incapable of countersinking a rivet hole on both sides of a sheet assembly and forming flush rivet heads on both sides. Such double flush riveting is highly desirable in a number of applications, such as in the seal contacting area of airplane doors and other assemblies where, for functional or aesthetic purposes, both exposed surfaces of the laminated assembly must be smooth.

In most automatic riveting machines, the sheets are clamped in place, a drill and countersink enter from above to form the rivet receiving hole, a lower anvil is positioned just below the rivet receiving hole, a rivet is installed and the rivet is squeezed between the lower anvil and an opposed upper anvil. In many operations the rivet has a preformed head of the desired shape, round head, brazier head, or flat head for example, and the rivet is inserted from the top side, thereafter the shank is headed on the lower side by squeezing to form a button-like lower head. In other operations a rivet slug is utilized and both the upper and lower heads are formed simultaneously by squeezing.

SUMMARY OF THE INVENTION

The present invention is a double flush riveting machine which is properly described as an accessory to, or improvement for, currently available riveting machines, in that it provides the capability of fastening a plurality of sheets or parts together by a rivet having a flush head on both exposed surfaces. Currently available riveting machines have the capability of drilling a rivet receiving hole, countersinking the upper surface around the rivet receiving hole, inserting a flat head rivet in the receiving hole, and upsetting the rivet shank to form a button-like head at the lower surface by means of a lower anvil. The present invention replaces the lower anvil on such riveting machines, thereby adding the capability of countersinking the lower surface around the rivet receiving hole, and upsetting the rivet shank by squeezing to form a flat head at the lower surface.

It is an object of the present invention to provide an improved riveting machine embodying double countersinking capabilities.

It is an object of the present invention to provide an improved riveting machine which produces riveted joints wherein both heads of each rivet are flat and substantially flush with the exterior surfaces of said joints.

Another object of the invention is to provide an accessory to existing riveting machines that provides the capability of double countersinking and double flush riveting a laminated assembly.

Another object of the invention is to provide a riveting machine having a lower anvil assembly which may be rotated through approximately three-hundred-sixty degrees to permit installing rivets in various hole patterns without necessitating the removal of the workpiece from the riveting machine in order to reorient the workpiece relative to the riveting machine each time the hole pattern changes direction.

The above objects and others are accomplished by the present invention utilizing a novel arrangement of motor, cylinders, limit switches, retractable anvil, and associated structure to sequentially retract the anvil, countersink the hole, position the anvil, and squeeze the rivet while providing the capability of the lower anvil assembly to be rotatable through approximately three-hundred-sixty degrees.

BRIEF DESCRIPTION OF THE DRAWINGS

The advantages of the present invention reside in the construction and cooperation of element herein described, reference being made to the accompanying drawings forming a part of this disclosure, wherein one embodiment of the invention is shown by way of example. It should be understood however that the drawings and description are for the purposes of illustration only and are not to be construed as defining or limiting the scope of the invention.

In the drawings, wherein like numbers designate like parts throughout the various figure.

DESCRIPTION OF THE PREFERRED EMBODIMENT

Figure 1:
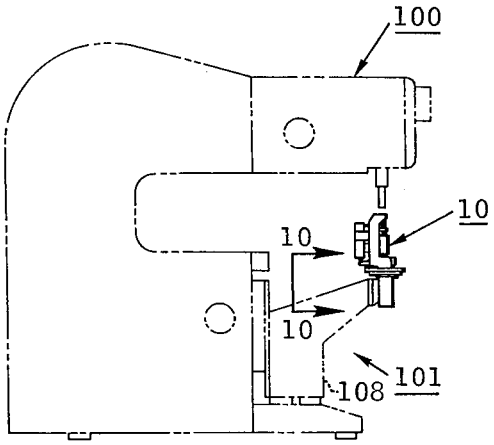
FIG. 1 shows the flush riveter installed in a conventional automatic riveting machine.

Referring to FIG. 1, there is shown a conventional riveting machine 100 having a knee assembly 101. Assembly 101 includes a pair of outer arms 108. Operable within the knee is a clamp arm (as seen in section at 110 in FIG. 10). The clamp arm and knee are operably attached to the flush riveter 10 and are the means for imparting mechanical motion and force to the flush riveter for clamping the workpiece and subsequently squeezing the rivet later herein. Both the knee and clamp arm are raised and lowered by means of fluid cylinders, and usually the outer arms 108 are controlled by a high pressure hydraulic cylinder and clamp arm 110 by a lower pressure air cylinder.

Figure 4:
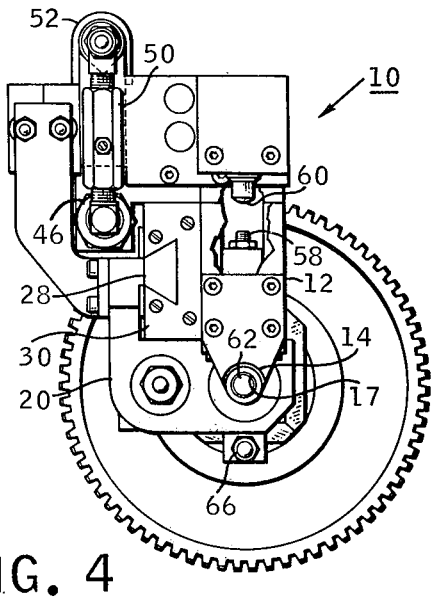
FIG. 4 is a top view of the flush riveter.
Figure 2:
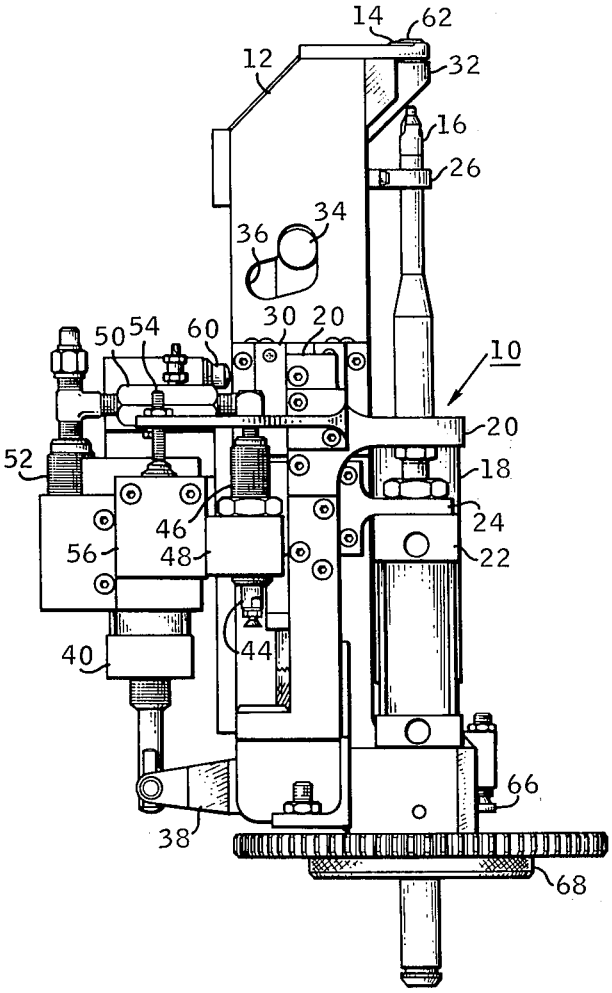
FIG. 2 is a side view of the flush riveter.
Figure 3:
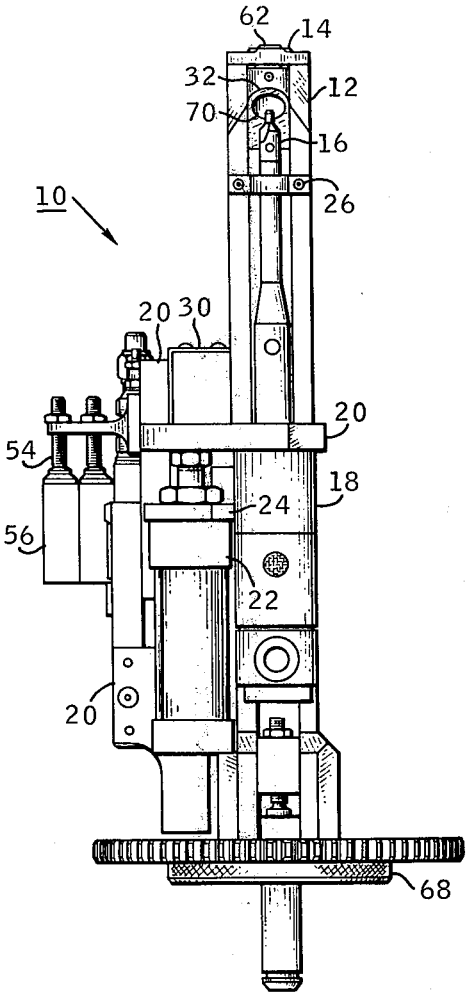
FIG. 3 is a front view of the flush riveter.

Referring to FIGS. 2, 3, and 4, there are shown side, front, and top views, respectively, of the present invention, flush riveter 10. The stationary portion of the flush riveter is a long vertical channel-shaped frame 12, having a circular support head 14 on the upper surface. A countersink tool 16 is positioned below and in alignment with a hole 17 in support head 14, the countersink tool 16 being powered by drill motor 18. Drill motor 18 is mounted to countersink carriage 20. Also attached to the carriage 20 is the piston rod of countersink cylinder 22. The cylinder portion of countersink cylinder 22 is attached to frame 12 by means of a mounting bracket 24. Extension of countersink cylinder 22 will raise the carriage 20, drill motor 18, and tool 16 relative to frame 12. The upper portion of tool 16 is guided by support bracket 26 which is attached to frame 12. Attached to carriage 20 is a truancated V block 28 which functions as a guide block for carriage 20 by moving up and down in track 30 attached to frame 12.

Slidably mounted within frame 12 is an anvil 32. Movement of anvil 32 within frame 12 is limited and controlled by a cam follower, or roller, 34 mounted on anvil 32 and located within cam slot 36 of frame 12. Attached to anvil 32 by means of bracket 38 is the piston of anvil cylinder 40, the cylinder portion being attached to frame 12. Anvil 32 is adapted for translation between a first position as seen in FIG. 2 and a second position in which cam follower 34 is at the opposite end of slot 36.

Figure 5:
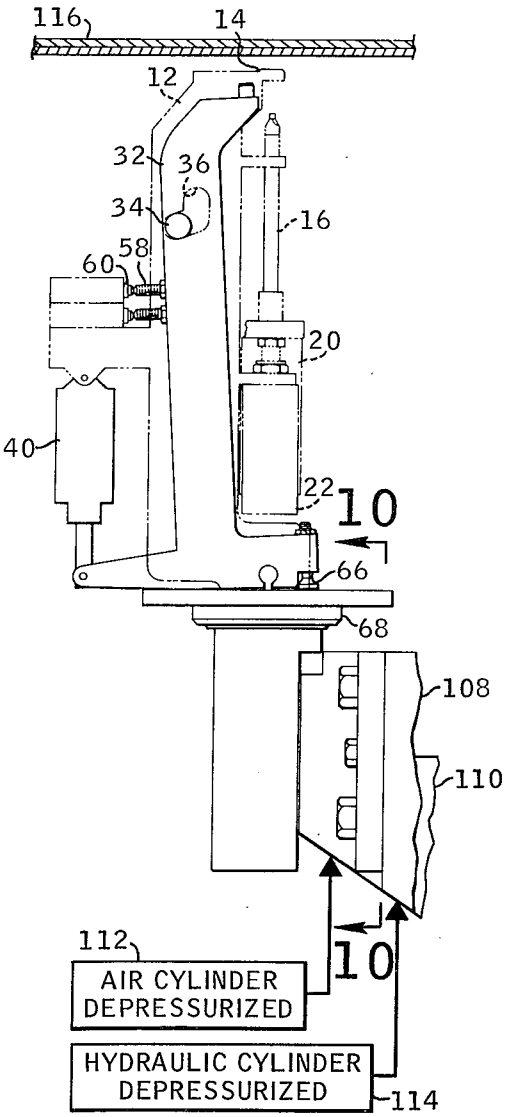

Referring now to FIGS. 5 through 10, wherein certain parts have been omitted in order to clearly illustrate the functioning cycle through the various clamping positions of the riveter. FIG. 5 shows the riveter in the rest position prior to begining the countersink and rivet operation. Both the air cylinder 112 driving the clamping arm 110 and the hydraulic cylinder 114 driving outer arms 108 are depressurized. Countersink 16 on drill motor 18 is retracted with retraction of countersink cylinder 22. Anvil 32 within frame 12 is retracted, with cam follower 34 at the lower end of cam slot 36. "Anvil retracted" switch 60 is actuated by adjustable stop 58. Adjustable anvil stop 66 is in contact with ring 74 mounted on base ring 68.

Figure 6:
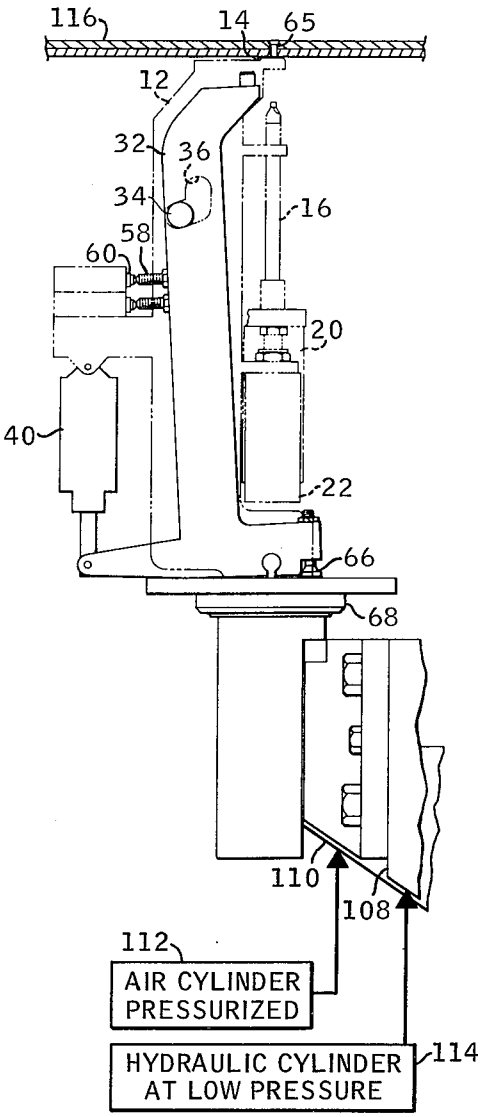

Air cylinder 112 is then actuated lifting clamp arm 110 upwardly to the position shown in FIG. 6. Hydraulic cylinder 114 is pressurized to a low valve, causing outer arms 108 to follow the movement of clamp arm 110, maintaining a constant relative position between outer arms 108 and clamp arm 110. Clamp arm 110 is connected by a bracket (not shown) within housing 113 to lift base ring 68. This brings frame 12 into clamping contact with the underside of workpiece 116, which typically comprises laminated metal sheets. An upper clamping means, part of the conventional riveting machine, clamps the upper surface of workpiece 116. For clarity, the conventional upper clamping means is omitted.

Figure 7:
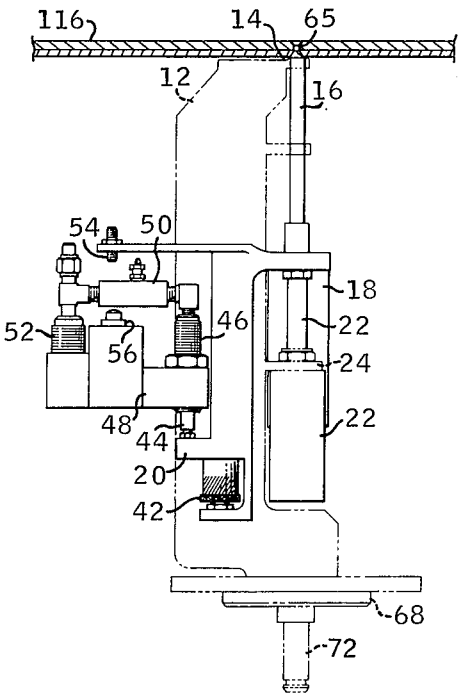
FIGS. 5 through 9 are side views of the riveter and clamping support means with various parts omitted for clarity, showing the sequence of operation of the clamping means through the unclamped, clamped and rivet squeezing positions.

FIG. 7 illustrates the countersinking step. In FIG. 7 the countersink cylinder 22 is fully extended and countersink tool 16 extends through hole 17 of frame 12. In this position the rivet receiving hole in workpiece 116 in contact with support head 14 is fully countersunk. The upward travel of carriage 20, drill motor 18, and tool 16, is limited, or stopped, by a micrometer adjustable stop 42, which is contacted by carriage 20.

The first portion of upward travel of carriage 20 is unrestricted, and the velocity is therefor a function of the stroke velocity of countersink cylinder 22. As the tool 16 approaches the workpiece, however, the vertical velocity is controlled by the carriage contacting feed-speed piston 44 disposed in feed-speed cylinder 46 which is mounted to frame 12 by means of bracket 48. Plumbed to feed-speed cylinder 46 is restricted-check valve 50, such that the oil within cylinder 46 that is displaced by piston 44 is restricted in flow velocity as it passes to accumulator cylinder 52.

When carriage 20 moves downward away from feed-speed piston 44, the oil in accumulator cylinder 52 is forced back into cylinder 46 via valve assembly 50, which does not restrict oil flow in that direction. When countersink cylinder 22 approaches its fully compressed position, the adjustable stop 54 mounted in carriage 20 contacts limit switch 56 which shuts off power to drill mmotor 18, as shown in the FIG. 11 schematic.

Upon completion of the countersinking operation, the riveter has returned to the position shown in FIG. 6. Drill motor 18 has been shut off and countersink cylinder 22 is fully retracted. Anvil 32 remains in the fully retracted position, with adjustable stop 58 fully depressing limit switch 60. Switch 60 provides the intelligence to countersink cylinder 22 that the anvil 32 is fully retracted and it is safe for cylinder 22 to raise countersink 16 up to the workpiece.

Figure 9:
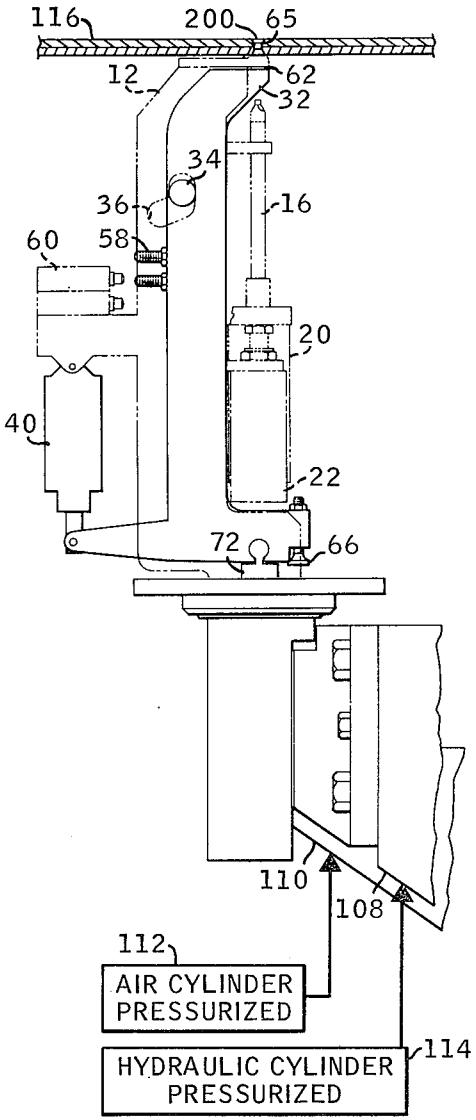
Figure 8:
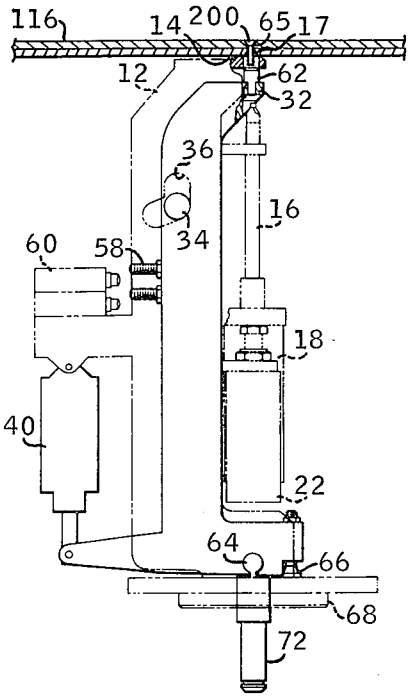

Referring now to FIG. 8 which illustrates the next sequential operation, it will be observed that anvil 32 has been rocked to the right from its retracted position (illustrated in FIG. 6) so that the heading die 62 of the anvil 32 is aligned directly below the hole 17 in frame 12. The anvil 32 was rocked into this position by the operation of anvil cylinder 40 which caused anvil 32 to rotate about anvil pivot pin 64 and anvil cam follower 34 to travel along cam slot 36 to the knee of the cam slot. Further rotation of the anvil about pivot pin 64 is prevented by the knee in cam slot 36 and by the adjustable anvil stop 66 contacting the base ring. A cutout 70 is provided in anvil 32 to clear tool 16 when the anvil is in this position (see also FIG. 3). In this position the rivet 200 is inserted into the rivet receiving hole in the workpiece from above, and the unheaded shank of the rivet extends below the workpiece into hole 17 of frame 12. Upward movement of anvil 32 will move heading die 62 upward into hole 17 to head the rivet, as illustrated in FIG. 9. Simultaneously a conventional anvil (not shown) moves downwardly to head the upper end of rivet 200.

FIG. 9 shows the position of anvil 32 when the rivet has been fully squeezed and headed. This final squeezing of the rivet requires a large force which is provided by the main rivet machine moving anvil rod 72 upward through hydraulic cylinder 114 raising outer arms 108 which connect to anvil rod 72 by a conventional bracket (not shown), thereby moving the anvil 32 straight up within frame 12, such movement being accommodated by further retraction of anvil cylinder 40 and vertical movement of cam follower 34 in cam slot 36. After the rivet is headed, pressure is removed from hydraulic cylinder 114 causing the anvil rod 72 to retract to the position shown in FIG. 8. At the same time pressure is supplied to the extend or down-side of anvil cylinder 40 and when cam follower 34 reaches the knee in cam slot 36 the anvil 32 rotates to the left until it reaches the position shown in FIG. 6. Air pressure cylinder 112 is depressurized to return the system to the position shown in FIG. 5.

Figure 10:
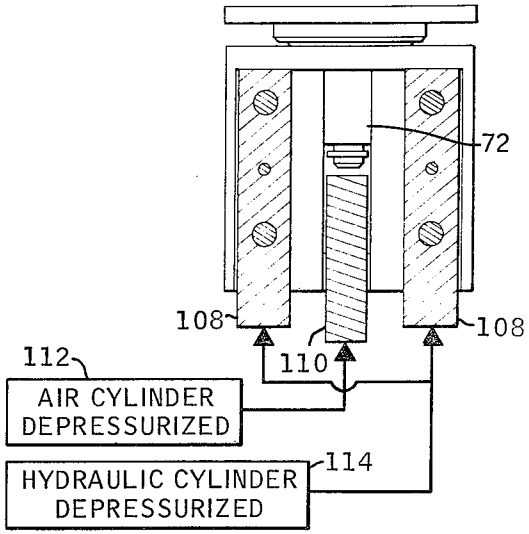
FIG. 10 is a somewhat schematic section taken on line 10—10 in FIGS. 1 and 5.

Ring 68 is mounted on a bracket fastened to clamp arm 110 in a manner which permits rotation of ring 68. Rotatability of the riveter will accommodate moving the riveter closely within an inside corner of a workpiece having downwardly extending flanges. The assembly may be rotated approximately 360°, the rotation limited only by the slack in electrical wiring and fluid hoses which attach to components of the flush riveter assembly. Brackets connecting anvil pin 72 to outer arms 108 and ring 68 to clamp arm 110 are not shown since these components are part of the conventional riveting machine which will vary with the machine used and are not part of this invention. FIG. 10 shows the relationship between outer arms 108, operatively connected to anvil pin 72, and inner arm 110, operatively connected to ring 68.

Figure 11:
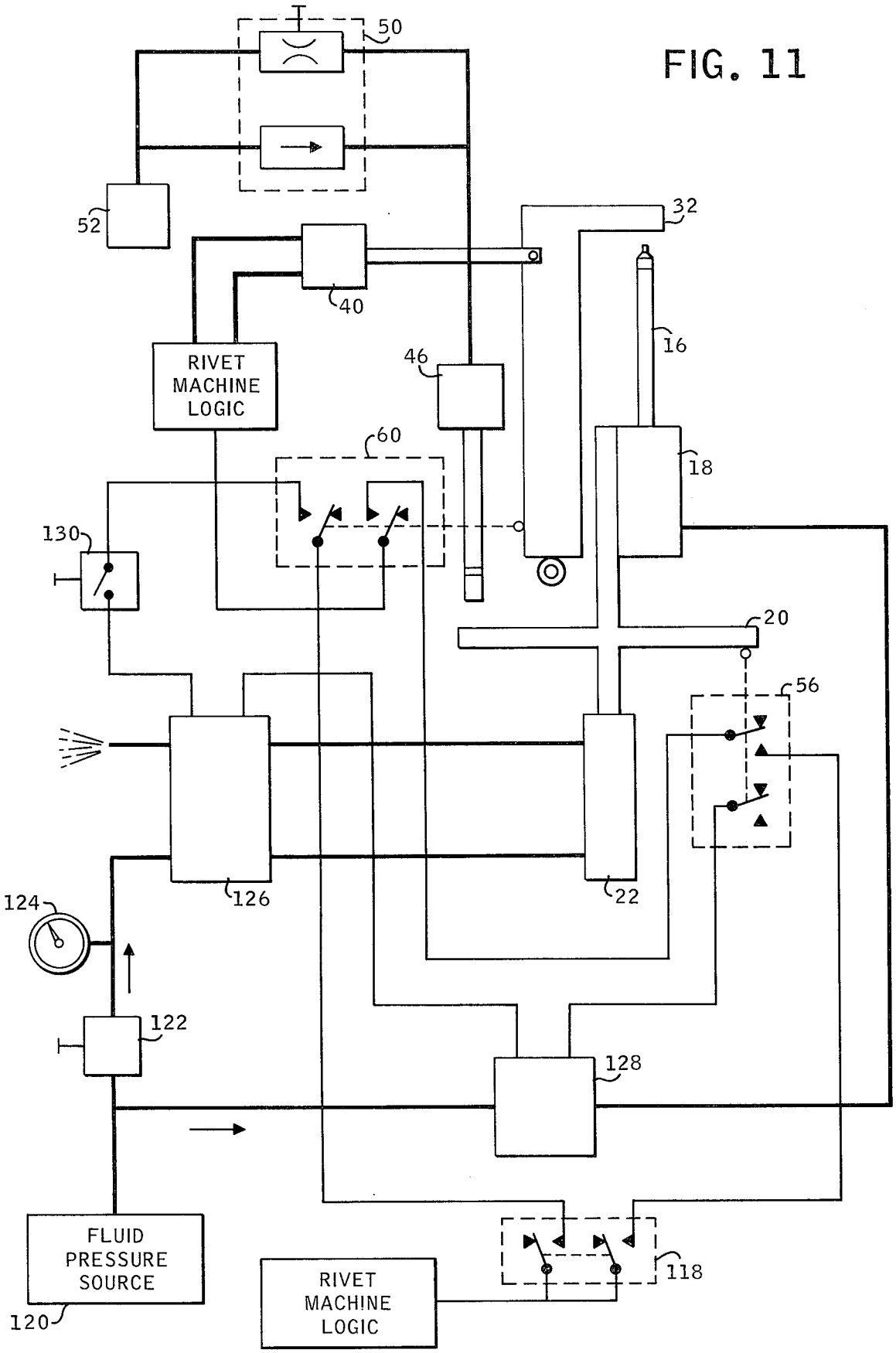
FIG. 11 is a functional schematic which shows the interrelationships of mechanical, electrical, and pneumatic/ hydraulic parts.

FIG. 11 is a simplified electrical and hydraulic schematic drawing showing the interconnection of the flush riveter with the conventional rivet machine control logic. This system permits tthe flush riveter to operate either in a "double flush" mode in which the lower workpiece surface is countersunk, or in a "normal" mode in which the lower surface is not countersunk.

The electrical system cooperates with the control circuitry of the conventional riveting machine with which the novel accessory is used. In the basic riveting machine, the machine automatically cycles through clamping, drilling, rivet insertion and squeezing steps. This sequence continues to be performed when selector switch 118 is in the left (as seen in FIG. 11), or "normal" position.

As indicated in the above discussion of the mechanical features, the operating sequence begins when the rivet machine logic activates air cylinder 112 to clamp the workpiece between an upper clamp and frame 12. The rivet machine then causes the rivet hole to be drilled from above. Next, with selector switch 118 in the right, or "double flush" position, the countersinking sequence is begun by a signal from the riveting machine that hole drilling is complete.

Fluid pressure from source 120 passes through a conventional adjustable pressure regulator 122 and pressure gage 124 to a four-way valve 126. The fluid pressure from valve 126 passes to countersink cylinder, which begins to drive carriage 20 upwardly. As carriage 20 begins to move, countersink "down" switch 56 is operated, opening shut-off valve 128 to start drill motor 18. As carriage 20 rises, it encounters feed-speed cylinder 46. This forces fluid through an adjustable orifice in restricted check valve assembly 50, slowing the ascent of carriage 20. As carriage 20 reaches the upper stop 42, the hole in the workpiece is countersunk. After the appropriate time interval set into adjustable timer 130, valve 126 is reversed and carriage 20 is moved downwardly until countersink "down" limit switch 56 is operated, shutting off power to drill motor 18 and operating four-way valve 126 to direct fluid pressure to anvil cylinder 40, causing anvil 32 to rotate into the position shown in FIG. 8, whereupon the rivet machine control system activates hydraulic pressure cylinder 114 as shown in FIG. 9 to squeeze the rivet which has been placed in the coutersunk workpiece hole. The rivet machine control logic then depressurizes both air cylinder 112 and hydraulic cylinder 114, returning the riveter to the original position. A signal from the rivet machine logic reverses the pressure to anvil cylinder 40, causing anvil 32 to withdraw until limit switch 60 is operated, providing a signal to the control for countersink cylinder 22 indicating that anvil 32 is fully retracted and it is safe for carriage 20 to be raised as the next riveting cycle is begun.

While FIG. 11 shows, in simplified schematic form, a double flush riveting accessory control system adapted to cooperate with the conventional control system of standard riveting machines, if desired individual switches and fluid pressure systems can be provided to manually control each operation making up the riveting cycle.

The double flush riveter has been shown and described with a channel-shaped frame 12, and a rectangular cross-section anvil body 32, but it should be understood that the invention is not limited to any particular cross-section or dimensions. For example, the cross-section of anvil body 32 may be circular and frame 12 may be made from tube stock, or the cross-section of anvil body 32 may be triangular, square, hexagonal, or other shapes, and where more stiffness is required in one plane than another the cross-section may be elliptical or other elongated shapes having a major axis.

From the foregoiong it should be clear that where a non-flush rivet head, such as for example a round head or brazier head, is desired on the upper surface of the workpiece, tool 16 of flush riveter 10 may drill the rivet receiving hole from the bottom side as well as countersink the lower surface, leaving only rivet insertion to be performed by the upper mechanism of the main rivet machine 100 prior to rivet squeezing. In a like manner tool 16 may drill the receiving hole when double flush riveting is desired, leaving only counter-sinking the upper surface and inserting the rivet to be accomplished by the upper mechanism prior to squeezing.

Other modifications, arrangements, and applications of the invention will be apparent to those skilled in the art upon reading this disclosure, and these are intended to be included within the scope of this invention, it being understood that the preceding description is by way of example and is not to be taken as a limitation, the spirit and scope of this invention being limited only by the following claims:

W claim:

1. An accessory for use with an automatic riveting machine of the type wherein means are provided for forming a rivet receiving hole in a workpiece assembly, countersinking the upper surface around said receiving hole, and inserting a rivet in said receiving hole, said accessory comprising:

a countersinking means disposed in a first position below and in alignment with said receiving hole for countersinking the lower surface around said receiving hole;

an anvil disposed in a first position below said workpiece assembly in close proximity to said countersinking means; and translating means for moving said countersinking means to a second position in clearance of said anvil, and translating said anvil into a second position in alignment with said rivet receiving hole for squeezing said rivet after insertion in said receiving hole, whereby said riveting machine in use with said accessory permits countersinking the surface around the rivet receiving hole on both sides of the work piece and forming flush rivet heads on both sides thereof.

2. The accessory of claim 1, wherein said countersinking means comprises a rotatable countersink tool and a drive motor for rotating said countersink tool.

3. The accessory of claim 1, wherein said translating means comprises a carriage attached to said countersinking means and a first power cylinder for moving said carriage in a vertical direction toward and away from said workpiece assembly.

4. The accessory of claim 3, wherein said translating means further comprises a cam slot, a cam follower, and a second power cylinder attached at one end to said anvil for translating said anvil from said first position to said second position and back to said first position.

5. An improved automatic riveting machine of the type having means for clamping a workpiece, inserting a rivet into a rivet receiving hole in said workpiece, and squeezing said rivet to form a head on the unheaded shank end of said rivet, wherein the improvement comprises:

a frame located below said workpiece and rotatably attached to the lower knee of said riveting machine;

an anvil slidably mounted within said frame;

a carriage mounted to said frame for reciprocating movement on said frame;

countersinking means mounted to said carriage for countersinking the lower surface around said rivet receiving hole; and actuation means connected between said frame and said carriage for reciprocating said carriage on said frame whereby the lower surface around said rivet receiving hole can be countersunk and the unheaded end of said rivet can be flush riveted on the bottom side of the work piece.

6. The riveting machine of claim 5 wherein said countersinking means comprises a rotatable tool for counter-sinking the lower surface of said workpiece, and a drive motor for rotating said tool.

7. The riveting machine of claim 6 wherein said rotatable tool further comprises a drill portion for forming said rivet receiving hole in said workpiece.

8. The riveting machine of claim 6 further comprising:

a cam surface located on said frame;

a cam follower rotatably fastened to said anvil and in contact with said cam surface; and translating means connected between said frame and said anvil for sliding said anvil in said frame, said sliding motion being controlled by said cam surface and said cam follower.

9. The riveting machine of claim 8 further comprising a feed-speed means mounted on said frame and positioned to contact said carriage during a portion of the reciprocating movement of said carriage.

10. The riveting machine of claim 9 further comprising a base ring fixedly mounted to said frame for controlling the rotational movement of said frame on said riveting machine knee.

11. The riveting machine of claim 9 wherein said feed-speed means comprises a piston located within a fluid-filled cylinder and means for restricting the exhaust flow of fluid displaced by said piston within said cylinder.

12. The riveting machine of claimi 11 further comprising an accumulator for storing said fluid exhausted from said feed-speed cylinder.

13. The riveting machine of claim 8 further comprising means for shutting off power to said countersink drive motor during a portion of the reciprocating motion of said carriage.

14. The riveting machine of claim 13 further comprising means for shutting off said carriage actuation means during a portion of the motion of said anvil.

* * * * *